US008598479B2

(12) United States Patent
Quan et al.

(10) Patent No.: US 8,598,479 B2
(45) Date of Patent: Dec. 3, 2013

(54) ELECTRONIC DEVICE WITH PUSH BUTTON

(75) Inventors: Tong-You Quan, Shenzhen (CN); Hai-Shan Zhong, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 292 days.

(21) Appl. No.: 12/912,765

(22) Filed: Oct. 27, 2010

(65) Prior Publication Data

US 2011/0278143 A1 Nov. 17, 2011

(30) Foreign Application Priority Data

May 13, 2010 (CN) ..... 2010 1 0171425

(51) Int. Cl.
*H01H 1/64* (2006.01)
*H01H 1/66* (2006.01)
*H01H 9/02* (2006.01)

(52) U.S. Cl.
USPC ..... 200/293; 200/341

(58) Field of Classification Search
USPC ..... 200/293, 341, 406, 344, 345, 516, 517, 200/520, 329
See application file for complete search history.

(56) References Cited

U.S. PATENT DOCUMENTS 7,576,291 B2 * 8/2009 Tseng et al. ..... 200/296
8,283,587 B2 * 10/2012 Ouyang ..... 200/345

FOREIGN PATENT DOCUMENTS

| | | |
|---|---|---|
| CN | 2251748 Y | 4/1997 |
| CN | 2819715 Y | 9/2006 |
| TW | 579011 | 3/2004 |
| TW | M311107 | 5/2007 |
| TW | 200929294 A | 7/2009 |
| TW | M366751 | 10/2009 |

* cited by examiner

*Primary Examiner* — Renee S Luebke
*Assistant Examiner* — Lheiren Mae Caroc
(74) *Attorney, Agent, or Firm* — Altis & Wispro Law Group, Inc.

(57) ABSTRACT

An electronic device includes a switch, a housing, a button, and an elastic element. The housing includes a cover and a sidewall enclosing the cover. The sidewall defines a receiving hole. The button is received in the receiving hole. The elastic element includes a base, a resisting portion, and an angled elastic arm connecting the resisting portion to the base. The resisting portion abuts against the button. The base is fixed to the cover. The elastic arm deflects when the button is pushed by an external force to actuate the switch, and rebounds to cause the button to move back when the external force has ceased.

2 Claims, 3 Drawing Sheets

ELECTRONIC DEVICE WITH PUSH BUTTON

BACKGROUND

1. Technical Field

The present disclosure relates to electronic devices, especially to an electronic device with a push button.

2. Description of Related Art

Electronic devices, such as LCD displays, cell phones and e-books, usually include one or more push buttons. The push button can return to its normal position upon release after being pushed. Although the push buttons satisfy basic requirements, a new type of push button is still needed.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
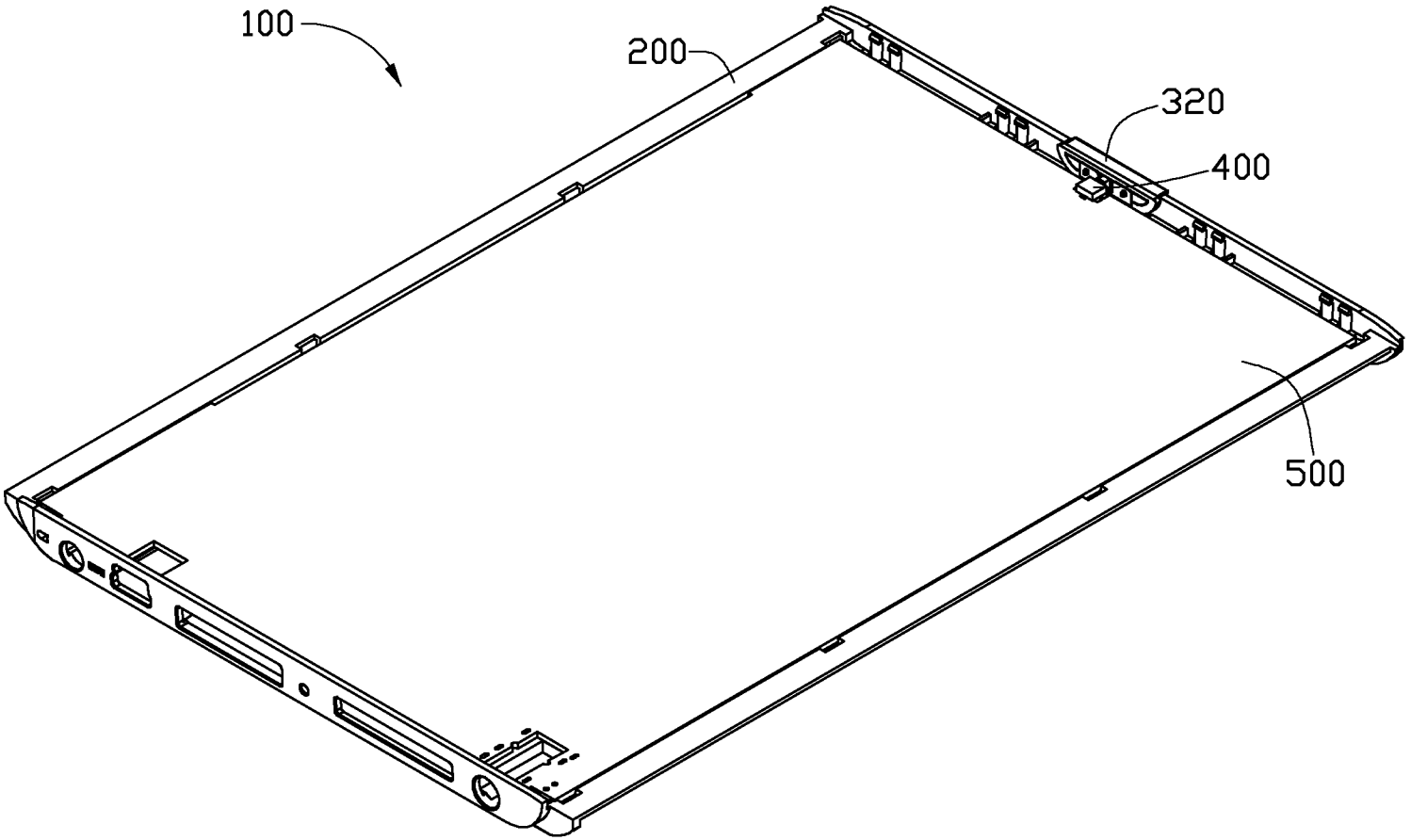
FIG. 1 is an isometric view of an electronic device according to an exemplary embodiment, with certain elements omitted for clarity.
Figure 2:
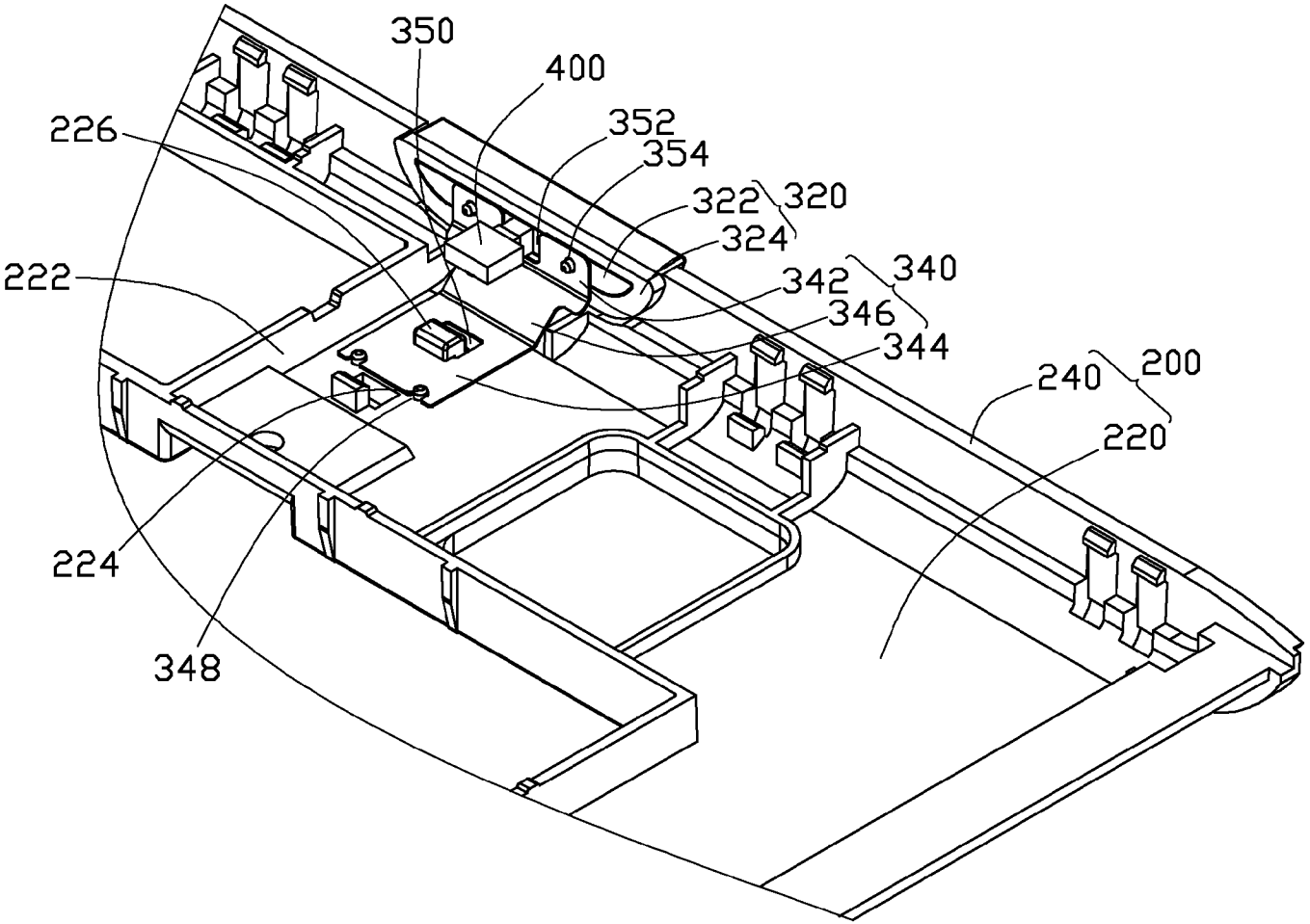
FIG. 2 is a partial, isometric view of the electronic device in FIG. 1.
Figure 3:
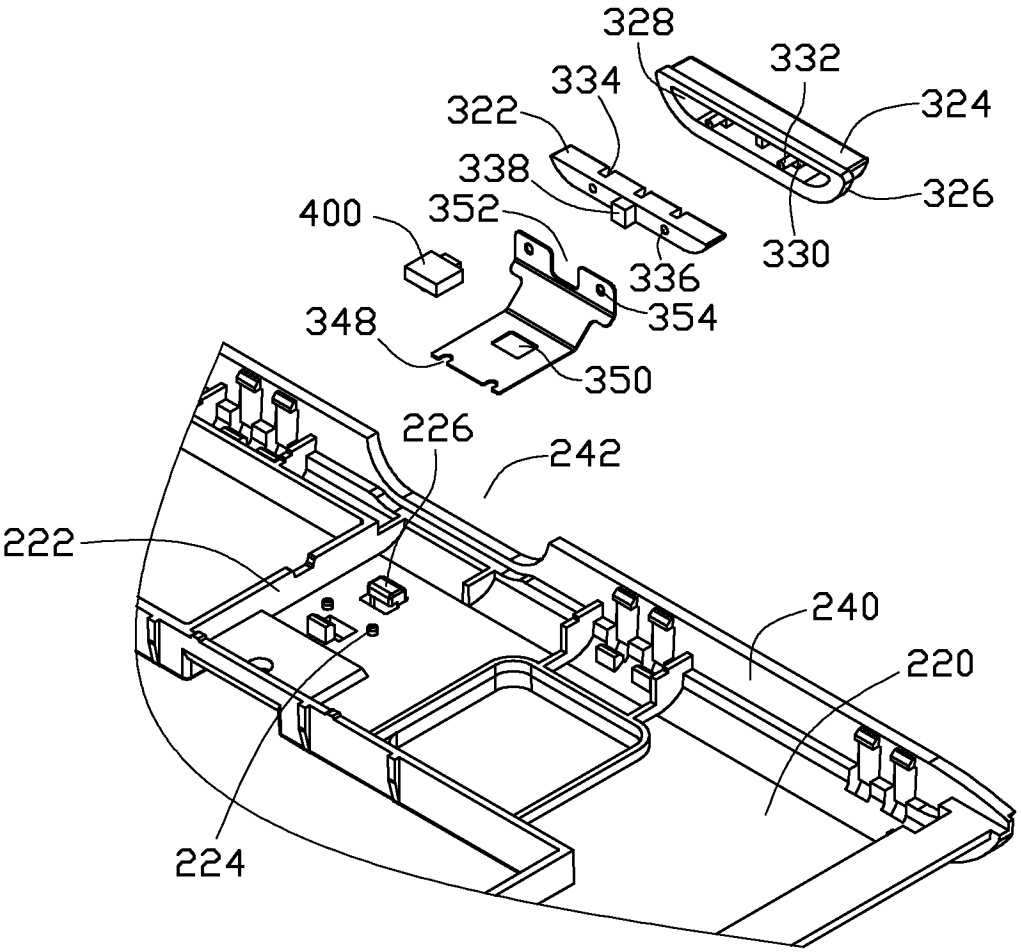
FIG. 3 is an exploded view of the electronic device in FIG. 2.

Referring to FIGS. 1 to 3, an electronic device 100 includes a housing 200, a button 320, a switch 400, a circuit board 500, and an elastic element 340. The housing 200 includes a cover 220 including a number of ribs 222, and a sidewall 240 enclosing the cover 220. The sidewall 240 defines a receiving hole 242. The circuit board 500 is disposed on the ribs 222 and fixed to the cover 220 by screws (not shown). The switch 400 is electrically connected to the circuit board 500. The button 320 is received in the receiving hole 242. The elastic element 340 is a thin metal sheet. The elastic element 340 includes a base 344, a resisting portion 342 perpendicular to the base 344, and an elastic arm 346 aslant connecting the resisting portion 342 to the base 344. The resisting portion 342 abuts against the button 320 and the base 344 is fixed to the cover 220. When being pushed, the button 320 moves inward to actuate the switch 400 and the elastic arm 346 deflects. The button 320 can return back to its initial position by the spring force from the elastic arm 346 when released.

Referring also to FIG. 3, two posts 224 and a hook 226 protrude from the cover 200. The base 344 defines two notches 348 in an edge thereof and a hole 350. The hook 226 extends through the hole 350 and presses against the base 344 to prevent the base 344 from moving in an up-down direction. The tabs 224 are respectively fit into the notches 348. The resisting portion 342 defines a notch 352 and two through holes 354. The notch 352 faces the switch 400.

The button 320 includes an actuating element 322 and a button body 324 for receiving the actuating element 322. The actuating element 322 is substantially cuboid. A protrusion 338 protrudes from a side of the actuating element 322. The protrusion 338 extends through the notch 352 and faces the switch 400. The actuating element 322 defines three slots 334 parallel to each other in a side opposite to the protrusion 338. The actuating element 322 further defines two through holes 336 that are aligned with the two through holes 354. The two through holes 336 communicate with two of the three slots 334.

The button body 324 includes a flange 326 arranged around its edge. The flange 326 is located within the housing 200 and abuts against the sidewall 240, which prevents the button 320 from disengaging from the housing 200. The button body 324 defines a receiving cavity 328 for accommodating the actuating element 322. Three ribs 330 are formed in the receiving cavity 328. The ribs 330 are respectively received in the slots 334 of the actuating element 322, to increase the friction between the button body 324 and the actuating element 322, thereby preventing the actuating element 322 from separating from the button body 324. Two posts 332 protrude from the end of two ribs 330. The two posts 332 extend through the through holes 336 and the through holes 354.

The space the elastic element 340 occupies in the pushing direction is only the thickness of the resisting portion 342, thus saves space for the electronic device 100.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. An electronic device comprising:

a switch;

a housing comprising a cover and a sidewall enclosing the cover, the sidewall defining a receiving hole;

a button received in the receiving hole; and an elastic element;

wherein the elastic element comprises a base, a resisting portion substantially perpendicular to the base and an elastic arm aslant connecting the resisting portion and the base, the resisting portion abuts against the button, the base is fixed to the cover, the elastic arm deflects when the button is pushed by an external force to actuate the switch, and rebounds to cause the button to move back when the external force has ceased;

wherein the button comprises a button body comprising a flange arranged around its edge, the flange is located within the housing and abuts against the sidewall;

wherein the button further comprises an actuating element, the button body defines a receiving cavity for accommodating the actuating element, the resisting portion defines a notch, a protrusion protrudes from a side of the actuating element, the protrusion passes through the notch and faces the switch; and wherein the actuating element defines a plurality of slots paralleled to each other in a side opposite to the protrusion, ribs are formed in the receiving cavity, the ribs are respectively received in the slots.

2. An electronic device comprising:

a switch;

a housing comprising a cover and a sidewall enclosing the cover, the sidewall defining a receiving hole;

a button received in the receiving hole; and an elastic element;

wherein the elastic element comprises a base, a resisting portion substantially perpendicular to the base and an elastic arm aslant connecting the resisting portion and the base, the resisting portion abuts against the button, the base is fixed to the cover, the elastic arm deflects when the button is pushed by an external force to actuate the switch, and rebounds to cause the button to move back when the external force has ceased; a plurality of posts and a hook protrude from the cover, the base defines a plurality of notches in an edge thereof and a hole, the hook passes through the hole and presses against the base, and the posts are respectively fitted into the plurality of notches.

* * * * *